US008955612B2

(12) United States Patent
O'Toole

(10) Patent No.: US 8,955,612 B2
(45) Date of Patent: Feb. 17, 2015

(54) FENCE POST DRIVER

(75) Inventor: Lawrence O'Toole, Mayfield (AU)

(73) Assignee: Onesteel Wire Pty Limited, Sydney (AU)

( * ) Notice: Subject to any disclaimer, the term of this patent is extended or adjusted under 35 U.S.C. 154(b) by 766 days.

(21) Appl. No.: 13/148,696

(22) PCT Filed: Feb. 10, 2010

(86) PCT No.: PCT/AU2010/000136

§ 371 (c)(1),
(2), (4) Date: Oct. 10, 2011

(87) PCT Pub. No.: WO2010/091458

PCT Pub. Date: Aug. 19, 2010

(65) Prior Publication Data

US 2012/0111593 A1 May 10, 2012

(30) Foreign Application Priority Data

Feb. 10, 2009 (AU) ..... 2009900525

(51) Int. Cl.
*E04H 17/26* (2006.01)
*E02D 7/00* (2006.01)

(52) U.S. Cl.
CPC ..... *E04H 17/263* (2013.01); *E02D 7/00* (2013.01); *E04H 17/26* (2013.01)
USPC ..... 173/90; 173/114; 173/132; 173/170; 405/228; 405/232

(58) Field of Classification Search
CPC ..... E04H 17/26; E04H 17/263; E02D 7/00; E02D 7/10; E02D 13/10
USPC ..... 173/90, 91, 168, 169, 170, 132, 114, 173/128, 184, 28; 405/232, 249, 228
See application file for complete search history.

(56) References Cited

U.S. PATENT DOCUMENTS

| | | | | | |
|---|---|---|---|---|---|
| 995,143 | A | | 6/1911 | Horn | |
| 1,569,857 | A | * | 1/1926 | Farb | 405/244 |
| 1,883,010 | A | * | 10/1932 | Sherwood | 175/85 |
| 2,681,779 | A | | 6/1954 | Veschio | |
| 2,844,006 | A | * | 7/1958 | Lutz et al. | 173/124 |
| 2,848,268 | A | | 8/1958 | McAuliffe | |
| 3,240,279 | A | * | 3/1966 | Dorkins | 173/193 |
| 3,616,866 | A | * | 11/1971 | Verheul et al. | 173/131 |
| 3,714,789 | A | * | 2/1973 | Chelminski | 405/232 |
| 3,897,835 | A | * | 8/1975 | Frederick | 173/131 |
| 4,063,599 | A | * | 12/1977 | Jansz | 173/1 |
| 4,075,858 | A | * | 2/1978 | Frederick | 405/228 |
| 4,119,159 | A | | 10/1978 | Arentsen | |
| 4,124,081 | A | * | 11/1978 | Deike | 173/28 |
| 4,366,870 | A | * | 1/1983 | Frederick | 173/131 |
| 4,479,550 | A | * | 10/1984 | Kuhn et al. | 173/112 |

(Continued)

FOREIGN PATENT DOCUMENTS

JP 2004-360404 12/2004

OTHER PUBLICATIONS

International Search Report for PCT/AU2010/000136, Apr. 2010.

*Primary Examiner* — Scott A. Smith
(74) *Attorney, Agent, or Firm* — Fulbright & Jaworski LLP

(57) ABSTRACT

A driver 10 for a fence post is disclosed. The driver comprises an elongate hollow body 12 having an open in-use lower end 14. A guide 16 is removably locatable at the lower end.

17 Claims, 6 Drawing Sheets

(56) References Cited

U.S. PATENT DOCUMENTS

| | | | | |
|---|---|---|---|---|
| 4,817,734 | A * | 4/1989 | Kuehn | 173/29 |
| 4,872,514 | A | 10/1989 | Kuehn | |
| 5,494,117 | A | 2/1996 | Aldridge | |
| 5,788,418 | A * | 8/1998 | Kuehn | 405/228 |
| 5,915,883 | A * | 6/1999 | Kuehn | 405/228 |
| 6,626,247 | B1 | 9/2003 | Nordlin | |
| 7,686,098 | B2 * | 3/2010 | Tyer | 173/53 |
| 7,950,470 | B2 * | 5/2011 | Reid | 173/90 |
| 8,033,756 | B2 * | 10/2011 | Adamson | 405/228 |

* cited by examiner

FENCE POST DRIVER

CROSS-REFERENCE TO RELATED APPLICATIONS

This application is a national stage of PCT/AU2010/000136 filed Feb. 10, 2011, claiming priority from AU 2099900525 filed on Feb. 10, 2009.

TECHNICAL FIELD

A fence post driver is disclosed that comprises an open end in which a guide can be removably located and which can be bell mouthed. The fence post driver can be powered (e.g. pneumatically driven), and may be hand-held or mounted on machinery (e.g. a tractor trailer, a stand etc).

BACKGROUND OF THE INVENTION

Fence post drivers are known that are either non-powered (e.g. hand-driven) or powered (e.g. pneumatically driven). When powered drivers are used to drive e.g. a steel fence post (such as a T-post, Y-post or star post), the lower end of the driver especially can become damaged or worn over time. This can necessitate repair or result in discard of the driver body. In addition, different drivers are required for different sizes of fence posts.

A reference to such background art is not an admission that the art forms a part of the common general knowledge of a person of ordinary skill in the art in Australia or elsewhere.

BRIEF SUMMARY OF THE INVENTION

In a first aspect there is disclosed a driver for a fence post. The driver comprises an elongate hollow body having an open in-use lower end. A guide having a hollow cylindrical body is removably locatable at the lower end and is adapted such that a substantial portion of the guide body can be removably located within the driver lower end in use.

By providing a guide that is removable the guide can be interchanged to accommodate different post sizes and enables easy guide replacement and maintenance. By locating a substantial portion of the guide body within the driver lower end in use this better supports the guide in use.

In one embodiment the guide comprises an elongate hollow body. In this embodiment the guide body is open at an in-use lower end, and is typically also open at an in-use upper end thereof.

In this embodiment a portion of the guide body can protrude beyond the lower end when the guide is located therein. This portion can be adapted (e.g. shaped) to abut a rim of the lower end when the guide is located therein. In this regard, the guide can define the lower fence post entrance into the driver.

The guide can be connected to the driver body via a releasable coupling (e.g. a quick-release coupling for ease of interchange). The releasable coupling can be provided on the guide body such that the coupling is located within the driver lower end in use. The coupling can be located between the guide and an inner wall of the driver body, thereby being protected from fence post impact.

The guide lower end can be provided with a bell mouth, so as to better direct and receive posts into the guide in use.

In this embodiment, one or more laterally extending, peripheral flanges can project out from the guide body. Each flange may be adapted to extend to an inner wall of the driver lower end when the guide is located therein, to help support and maintain the positioning of the guide in the driver body in use.

For example, three such flanges may be provided on the guide body:

- one that is located adjacent to an in-use guide lower end when that end sits adjacent to the driver lower end;
- one that is located intermediate the in-use guide lower end and a guide upper end; and
- one that is located at the in-use guide upper end.

The releasable coupling may be provided to operate on the flange that is located at the guide upper end in use.

In a second aspect there is disclosed a driver for a fence post. The driver comprises an elongate hollow body having an open in-use lower end. The lower end defines a bell mouth located at a rim of the lower end.

The bell mouth helps direct and receive posts into the driver lower end in use. This can mitigate damage at the driver lower end, and can extend driver life.

The bell mouth can alternatively or additionally be provided in a guide that is removably locatable at the lower end. In this regard, both a lower end of a driver body and the guide can be provided with a bell mouth. This guide can be as defined in the first aspect.

The driver of both the first and second aspects can be powered (e.g. pneumatically) or can be hand driven. When powered, the driver may be hand-held or mounted on machinery (e.g. on a tractor trailer, stand, etc).

A body of the driver of both the first and second aspects can comprise an upper end that is closed by a plate that impacts upon the fence post in use of the driver.

When the driver is powered, a drive motor (e.g. a pneumatically powered drive motor) can be located within the driver body at an in-use upper end thereof (e.g. on an opposing side of the plate to the side at which the post impacts in use). In this regard, the driver body may comprise a cylindrical housing in which the motor is located.

When the driver is hand-held (and for either a powered or non-powered driver), the driver body can be provided with handles located to project laterally out from opposing sides thereof. The handles can be provided with grips. Further, when the driver is powered, a trigger can be located adjacent to one of the handles for easy motor control.

In a third aspect there is disclosed a guide for a fence post driver. The guide has a hollow cylindrical body and is removably mountable at an in-use lower end of the driver. The guide is adapted such that a substantial portion of a body of the guide can be removably located within the driver lower end in use.

The guide of the third aspect can be as defined in the first and second aspects.

BRIEF DESCRIPTION OF THE DRAWINGS

Notwithstanding any other forms which may fall within the scope of the fence post driver and guide as defined in the Summary, specific embodiments of the driver and guide will now be described, by way of example only, with reference to the accompanying drawings in which.

DETAILED DESCRIPTION OF THE INVENTION

Figure 1:
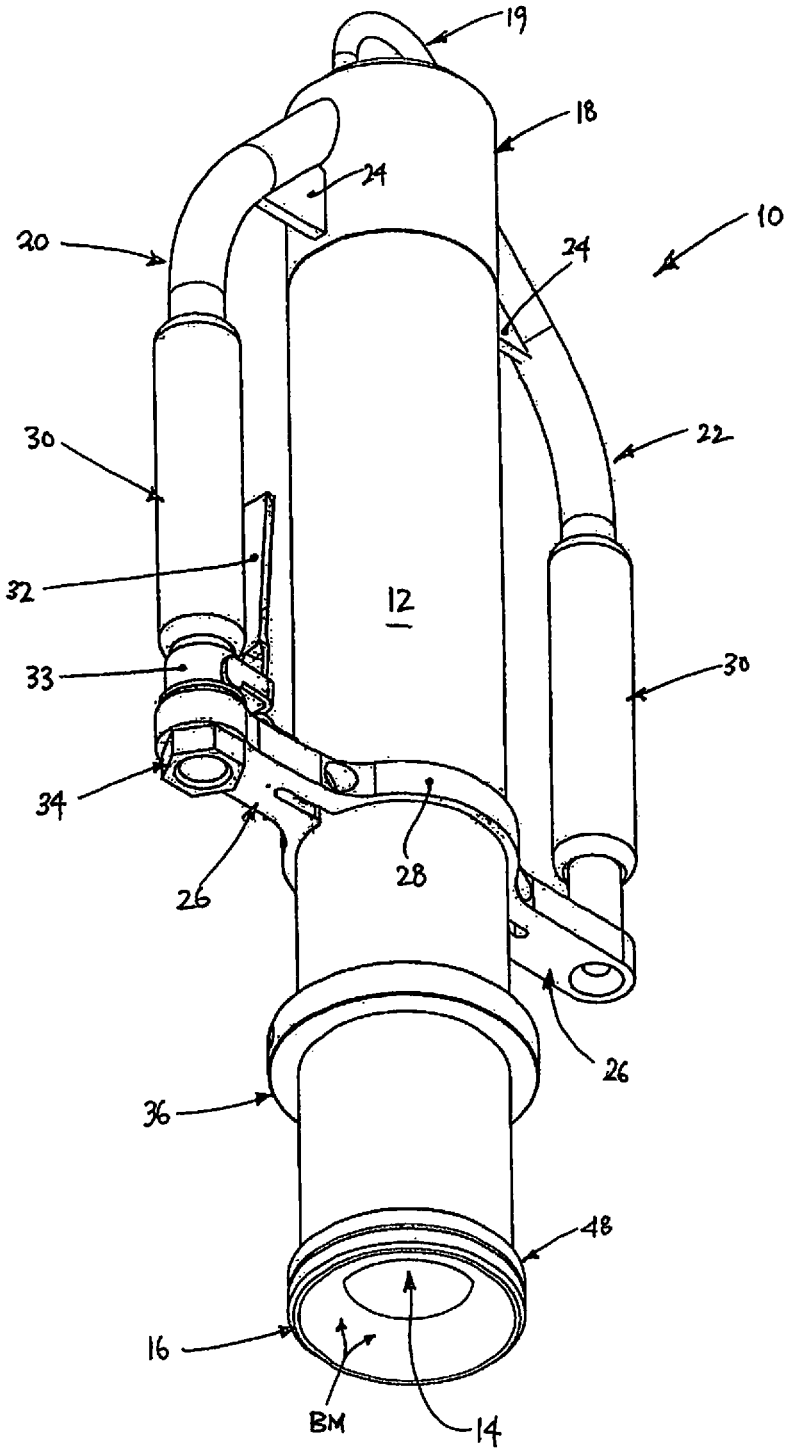
FIG. 1 shows a perspective view of a fence post driver embodiment with a removable fence post guide inserted into a lower end of a body of the driver.
Figure 2:
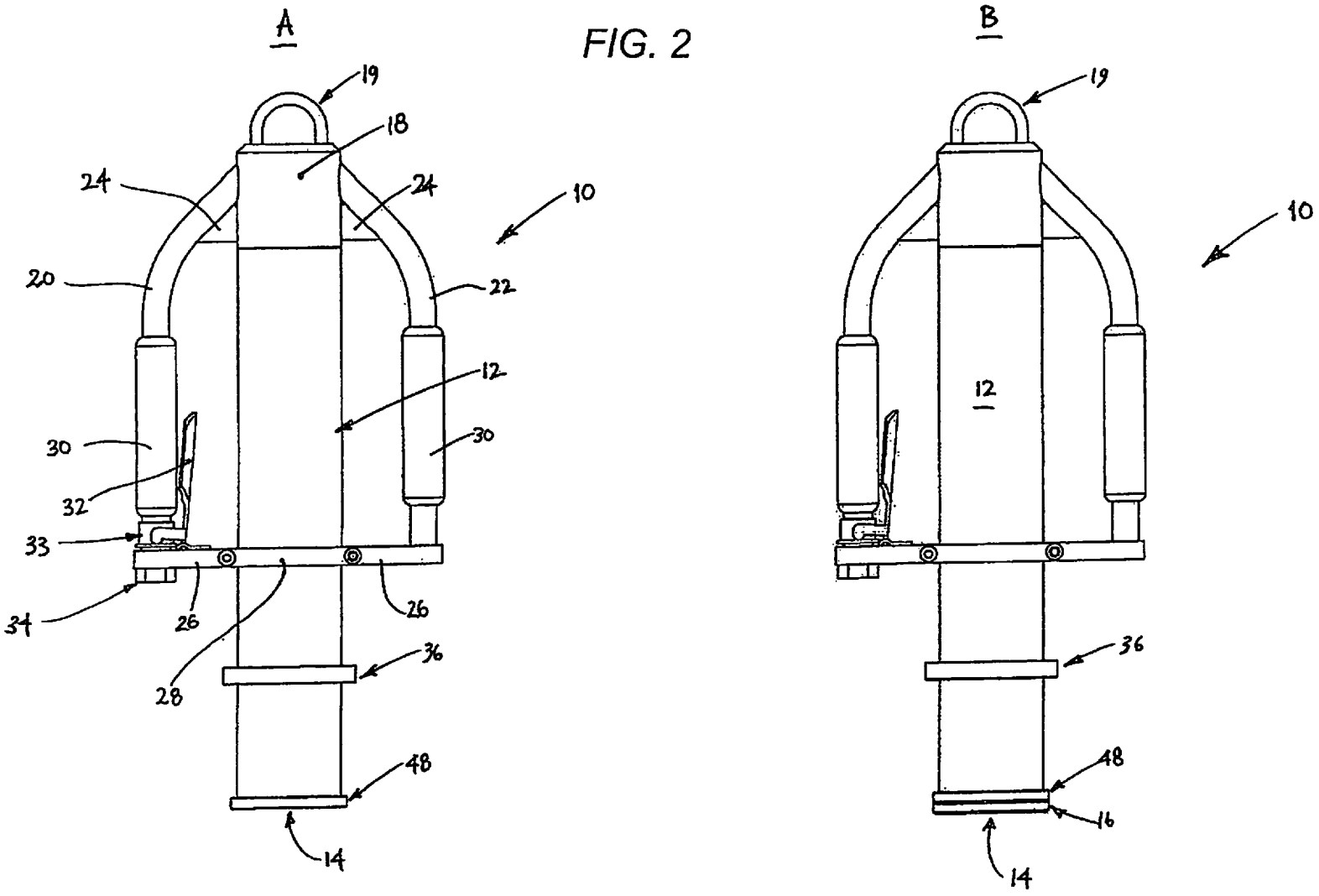
FIGS. 2A and 2B respectively show, in side view, the fence post driver embodiment of FIG. 1 with the guide removed (2A) and inserted (2B) into the driver body lower end.

Referring firstly to FIGS. 1 and 2, a driver for a fence post is shown in the form of a pneumatic post driver 10. The driver 10 is particularly suited to driving an elongate steel fence post (such as a T-post, Y-post or star post) into the ground, though can be readily adapted to drive other post types.

The driver 10 comprises an elongate and hollow cylindrical body 12 having an open lower end 14. A guide in the form of an interchangeable quick-release guide component 16 is removably locatable in the lower end 14.

By employing an interchangeable guide component 16 it becomes easy for the post driver 10 to accommodate different post sizes. In this regard, the cylindrical body 12 can be sized to accommodate a larger format steel fence post, whereas a range of guide components for differing and progressively smaller fence post sizes can be selected for interchange. When worn or damaged, the guide component can be easily replaced or easily removed for maintenance/repair.

The driver 10 can be powered by air or other gas, or can be hand driven. In its powered format, the driver may be hand-held or mounted on machinery (e.g. on the rear of a tractor arm, on a tractor trailer, on a separate stand, etc).

In its powered format, the driver 10 comprises a pneumatically powered drive motor that is located in a cylindrical housing 18 that is mounted at the upper end of the cylindrical body 12. The housing comprises a mounting loop 19 to enable hanging support of the driver 10. The pneumatic motor is located within the housing 18 on an opposing side of an impact plate, against which plate an upper end the fence post is impacted in use to drive the post into the ground.

To enable the driver to be hand-held (in either a powered or non-powered driver), the driver 10 is provided with opposing handles 20 and 22, which at their upper ends are mounted (e.g. by welding) to project laterally out and down from opposing sides of the housing 18. The mounting of the handle upper ends are each reinforced by a gusset 24 that is e.g. welded between the handle and housing. At their lower ends the handles are mounted to a respective arm 26, with each arm projecting laterally out from a respective opposing side of a collar 28. The collar 28 is fastened to the cylindrical body 12 intermediate its ends.

Each handle 20, 22 is provided with a grip 30. Adjacent to the grip 30 on handle 20 a trigger 32 is located for ease of providing variable control to the pneumatic motor via a flow control valve 33. In this regard, a gas line connection nut 34 is secured adjacent to a lower end of the handle 20, at the underside free end of arm 26. A gas pressure line comprising pressurised gas for the pneumatic motor can be attached to the nut, to thereby provide a gas flow connection with the interior of handle 20. This flow can be transmitted up the indie of the handle to flow up into the pneumatic motor located within the housing 18. The trigger can regulate (control) the amount of gas flowing to the motor (e.g. no flow when not depressed, to maximum flow when fully depressed, and flow (power) amounts therebetween).

FIGS. 1 and 2 also show an actuation ring 36 that is mounted to the cylindrical body 12. Rotation of the ring 36 on the body 12 actuates the quick-release coupling, as will be described in detail below.

Figure 3:
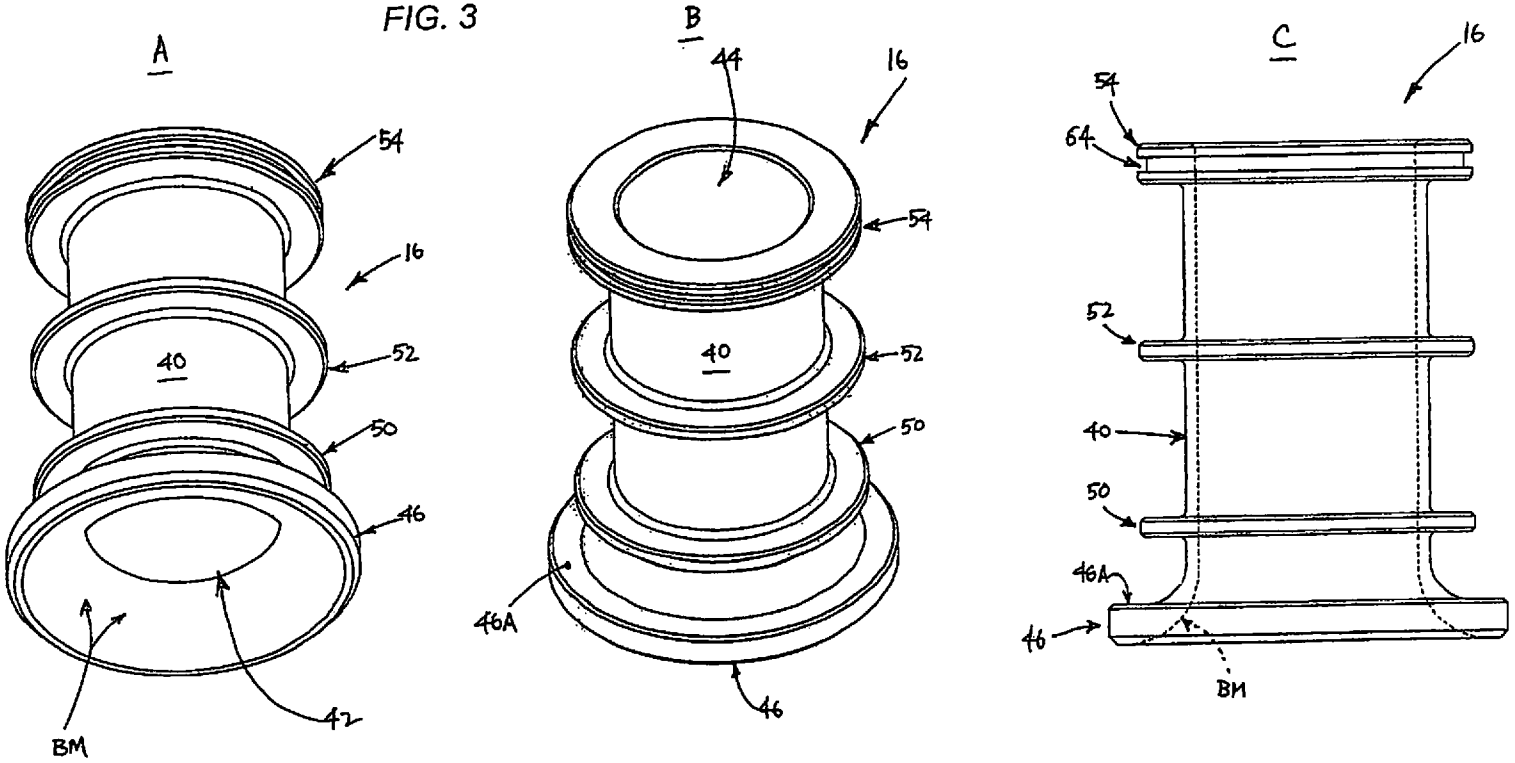
FIGS. 3A, 3B and 3C respectively show, in underside perspective, top perspective and side views, the removable fence post guide.
Figure 4:
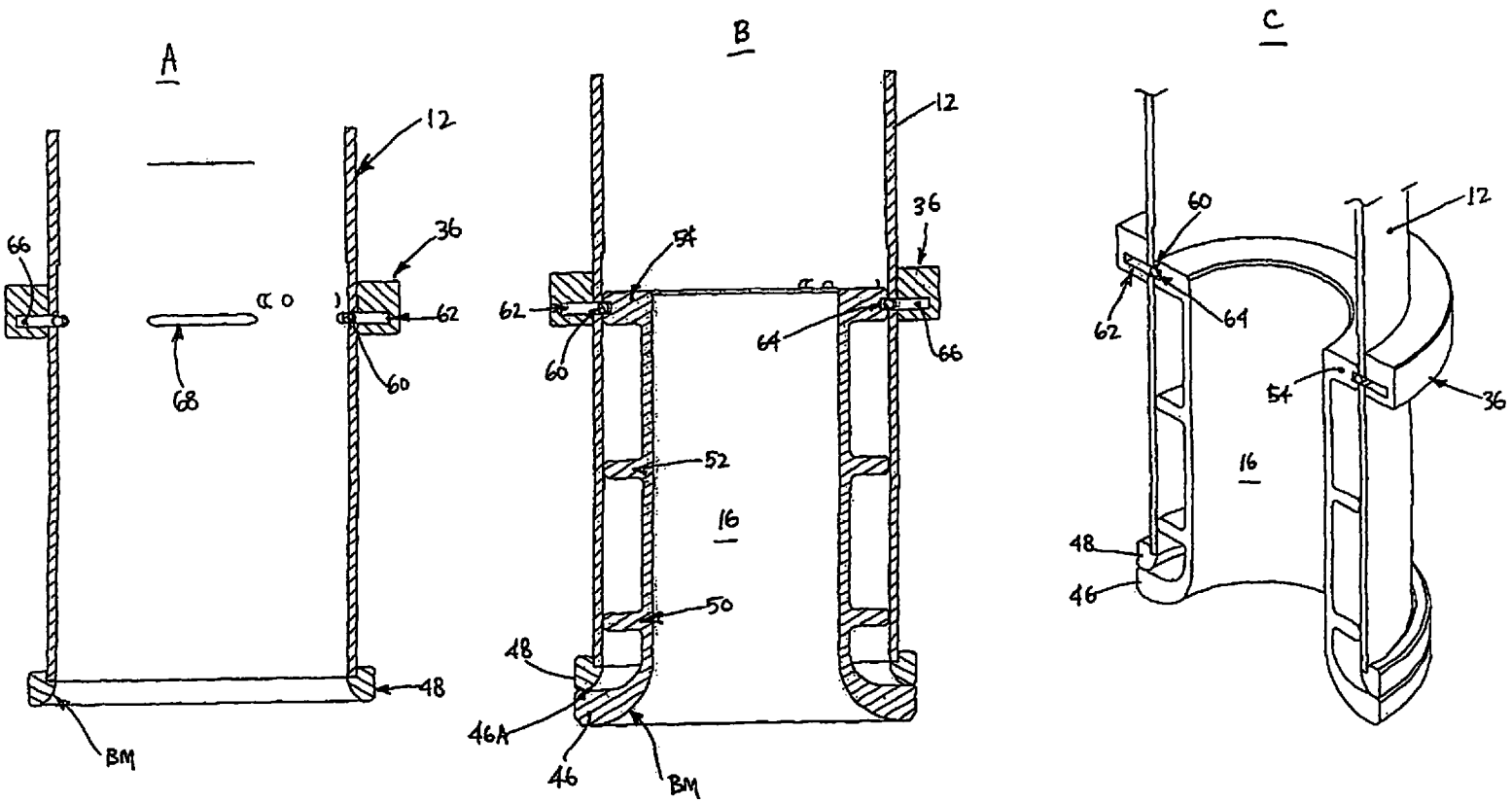
FIGS. 4A, 4B and 4C respectively show, in side sectional details and side perspective sectional detail, the fence post guide being located into the driver body lower end.

Referring now to FIGS. 3 and 4, the guide component 16 comprises an elongate hollow (cylindrical) body 40. The guide body 40 is open at both its lower end 42 and its upper end 44. As shown in FIGS. 4B&C, to provide maximum support to the guide component 16 in use, a substantial portion of the guide body 40 is locatable for releasable fastening within a lower end of the cylindrical body 12 of the driver 10.

The lower end 42 of the guide body flares out to define a guide mouth flange 46 that protrudes in-use when the guide is located in the lower end of body 12 (i.e. as shown in FIGS. 1, 2B and 4B&C). The mouth flange 46 can be configured at its upperside 46A to abut a rim ring 48 that is mounted at the lower end when the guide is located therein.

In this regard, when the guide component 16 is removed from the lower end of body 12 (FIG. 4A) the ring 48 defines the lower fence post entrance into the driver (e.g. for a larger format fence post). When the guide component 16 is located in the lower end of body 12 (FIGS. 4B&C) it defines the lower fence post entrance into the driver (e.g. for a smaller format fence post). In either case, it will be seen that both the ring 48 and the guide lower end 42 are provided with a bell mouth BM. Such a bell mouth better directs and receives posts into the driver in use. This can mitigate damage at the driver lower end, and can extend driver life.

The guide body 40 further comprises three spaced laterally extending, peripheral flanges 50, 52 and 54 that project out from the guide body, so as to extend to an inner wall of the lower end of body 12 when the guide component 16 is located therein (as best shown in FIGS. 4B&C). The flanges help support and maintain the positioning of the guide component 16 in the driver body 12 in use (i.e. during repeated fence post impact).

The flange 50 is located adjacent to the lower end 42 of the guide body 40, near to but spaced from guide mouth flange 46. The flange 52 is located intermediate the guide lower end 42 and upper end 44. The flange 54 is located at the in-use guide upper end.

The guide component 16 is connected to the driver body via a releasable, quick-release coupling for ease of guide interchange. The quick-release coupling is provided to act between the upper flange 54 and the actuation ring 36 (that is mounted to surround and rotate on the cylindrical body 12). The quick-release coupling is thereby located between the guide component 16 and an inner wall of the driver body, thereby being protected from fence post impact.

The quick-release coupling comprises a circular spring 60 that in use becomes located in an enclosed circumferential groove 62. A part 64 of this groove is defined in and around the periphery of the upper flange 54, and a part 66 of this groove is defined within and around an internal periphery of the actuation ring 36. A further part of the enclosed groove is defined by a series of slots 68 (see especially FIG. 5) defined through the wall of the driver body 12.

Figure 6:
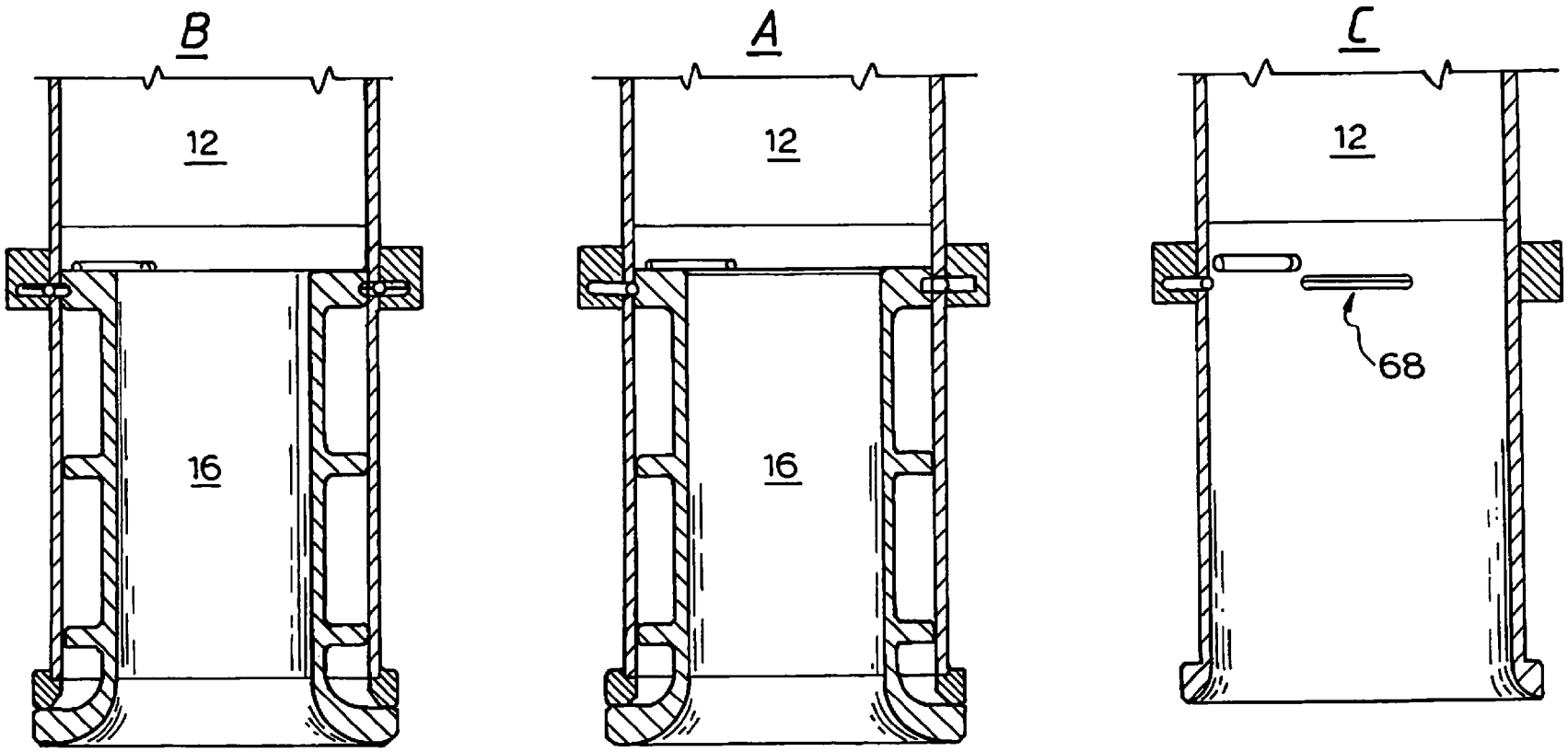
FIGS. 6A to 6C schematically depict, in side sectional view, a sequence for unlocking and removing the fence post guide from the driver body lower end.

As shown in FIGS. 4 and 6, the actuation ring 36 is loaded by the spring 60 so that it is biased by the spring into a "locked" rotational position on the cylindrical body 12. In this position, the guide component 16 is connected and locked to the driver body via the quick-release coupling—in this regard, spring 60 is located in the groove part 64 of the upper flange 54 (FIGS. 4B & C and FIG. 6A).

To release the guide 16, the ring 36 is rotated on the cylindrical body 12 in a direction against the spring bias, causing the spring to move out of groove part 64 of the upper flange 54, and to move into the slots 68 and the groove part 66 of the ring 36. This unlocks the guide component 16 with respect to the driver body (FIG. 6B) so that the guide component can now be slidably removed out of the driver body lower end.

With the guide component now removed, when the actuation ring 36 is then released by hand, the loading on it by the spring 60 rotates it back to the "locked" position (FIGS. 4A and 6C). When the same or a new guide is to be re-inserted, the actuation ring 36 is rotated by hand to the unlocked position, the guide component is slidably inserted and, once fully inserted, the ring is released and is urged by spring 60 back to its locked position, and so that the circular spring 60 also locks the guide component in place (FIGS. 4B & C and FIG. 6A).

Figure 5:
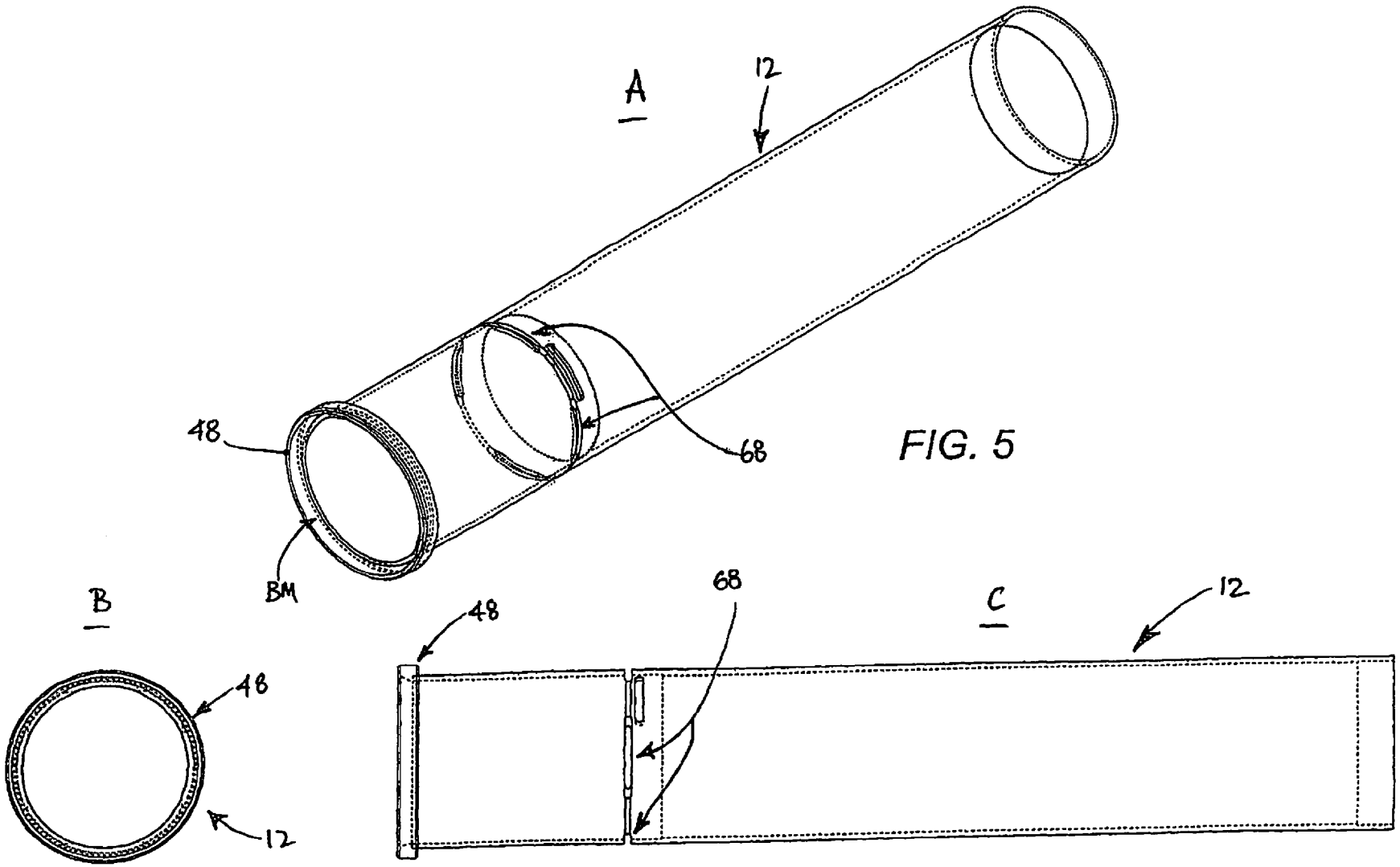
FIGS. 5A to 5C respectively show, in perspective, end and side views, an embodiment of the fence post driver body.

In FIG. 5 the elongate hollow cylindrical form of the driver body 12 is clearly depicted, with the slots 68 being clearly shown, and with the rim ring 48 being mounted at the in-use lower end thereof.

Whilst a number of fence post driver and guide embodiments have been described, it should be appreciated that the driver and guide may be embodied in other forms.

For example, the driver body 12 can be provided with a cross-sectional profile that is matched to other types of fence posts (e.g. elongate hollow bars). Also, the driver body can form part of a machine that is stand-alone (i.e. not hand-held such as a ground-mounted stand), or that is mounted on machinery (e.g. an actuated arm located on the back of a tractor, excavator or the like).

When the driver is motorised, the "power" supplied to the motor can come from an electrical supply (electrical motor), via a fuel supply (petrol- or gas-driven motor) or via a compressed gas such as air (pneumatic motor). The "power" supplied to the motor can be supplied by a prime mover (e.g. a tractor, excavator or the like) or can come from a compressor (pneumatic motor), generator (electric motor) etc.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the driver and guide.

What is claimed is:

1. A driver for a fence post, the driver comprising:

an elongate hollow body having an open in-use lower end: and a guide having a hollow cylindrical body, a flange that is located at an in-use upper end of the guide, and a releasable coupling positioned on the flange, the guide being adapted such that a substantial portion of the guide body can be removably located within the driver lower end in use.

2. A driver as claimed in claim 1 wherein a portion of the guide body protrudes beyond the lower end when the guide is located therein, with the protruding portion being adapted to abut a rim of the lower end when the guide is located therein.

3. A driver as claimed in claim 1 wherein the guide is connectable to the driver body via a releasable coupling.

4. A driver as claimed in claim 3 wherein the releasable coupling is a quick-release coupling that is located within the driver lower end in use.

5. A driver as claimed in claim 1 wherein the guide lower end is provided with a bell mouth.

6. A driver as claimed in claim 5 wherein the bell mouth is located at a rim of the guide lower end.

7. A driver as claimed in claim 6 wherein the bell mouth defines a curved surface that extends from an inside wall of the hollow cylindrical body of the guide at the lower end to an outside edge of the rim.

8. A driver as claimed in claim 1 wherein one or more laterally extending, peripheral flanges project out from the guide body.

9. A driver as claimed in claim 8 wherein each flange is adapted to extend to an inner wall of the driver lower end when the guide is located therein.

10. A driver as claimed in claim 8 wherein the guide body comprises three such flanges:

one that is located adjacent to an in-use guide lower end when that end sits adjacent to the driver lower end;

one that is located intermediate the in-use guide lower end and a guide upper end; and one that is located at the in-use guide upper end.

11. A driver as claimed in claim 1 wherein, the driver body is provided with handles located to project laterally out from opposing sides thereof.

12. A driver as claimed in claim 11 wherein the handles are provided with grips.

13. A guide for a fence post driver comprising:

a guide having a hollow cylindrical body, a flange that is located at an in-use upper end of the guide, and a releasable coupling positioned on the flange, the guide being removably mountable at the in-use lower end of the driver, and adapted such that a substantial portion of a body of the guide can be removably located within the driver lower end in use.

14. A guide as claimed in claim 13 that wherein a portion of the guide body protrudes beyond the lower end when the guide is located therein, with the protruding portion being adapted to abut a rim of the lower end when the guide is located therein.

15. A guide as claimed in claim 13 that is connectable to the driver body via a quick-release coupling that is located within the driver lower end in use.

16. A guide as claimed in claim 13 wherein a lower end of the guide is provided with a bell mouth.

17. A guide as claimed in claim 13 wherein one or more laterally extending, peripheral flanges project out from the guide body, with each flange being adapted to extend to an inner wall of the driver lower end when the guide is located therein.

* * * * *